US006400924B1

(12) United States Patent
Watanabe

(10) Patent No.: US 6,400,924 B1
(45) Date of Patent: Jun. 4, 2002

(54) FIXING ROLLER AND FIXING APPARATUS

(75) Inventor: Osamu Watanabe, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

(21) Appl. No.: 09/703,810

(22) Filed: Nov. 2, 2000

(30) Foreign Application Priority Data

Nov. 5, 1999 (JP) ..... 11-314518
Oct. 25, 2000 (JP) ..... 2000-325153

(51) Int. Cl.[7] ..... G03G 15/20

(52) U.S. Cl. ..... 399/333; 219/619; 399/328; 399/330

(58) Field of Search ..... 29/17.1, 17.3; 219/216, 619; 399/122, 328, 329, 330, 331, 333; 430/98, 99

(56) References Cited

U.S. PATENT DOCUMENTS 5,745,833 A * 4/1998 Abe et al. ..... 399/330
5,768,673 A * 6/1998 Morigami ..... 399/330
6,055,403 A 4/2000 Watanabe ..... 399/328

FOREIGN PATENT DOCUMENTS

JP 59-33787 2/1984
JP 2001-194943 * 7/2001

* cited by examiner

*Primary Examiner*—Sophia S. Chen
*Assistant Examiner*—Hoang Ngo
(74) *Attorney, Agent, or Firm*—Fitzpatrick, Cella, Harper & Scinto

(57) ABSTRACT

The present invention provides a fixing roller which has a metal layer, the metal layer having a thickness not less than 0.1 mm and not more than 2 mm, a tensile strength of 490 MPa or greater, and a yield point of 294 MPa or greater, and a fixing apparatus which has a fixing roller having a metal layer, and a back-up member forming a nip with the fixing roller, wherein a recording material bearing an unfixed image is nipped and conveyed by the nip, and the unfixed image is fixed on the recording material, and wherein the metal layer of the fixing roller has a thickness not less than 0.1 mm and not more than 2 mm, a tensile strength of 490 MPa or greater, and a yield point of 294 MPa or greater.

18 Claims, 4 Drawing Sheets

FIXING ROLLER AND FIXING APPARATUS

BACKGROUND OF THE INVENTION

1. Field of the Invention

This invention relates to a fixing apparatus applied to an image forming apparatus such as a copier or a printer, and particularly to a fixing roller applied to the fixing apparatus.

2. Related Background Art

In image forming apparatuses such as copiers adopting the electrophotographic method, a fixing apparatus for effecting a heating process on a sheet which is a recording medium such as recording paper or a transferring material bearing an unfixed toner image thereon to thereby fix the unfixed image on the recording medium is known as a typical example of heating apparatuses.

Such a fixing apparatus is provided with a fixing roller which is a heating member for heat-melting, for example, of the toner of the toner image on the sheet, and a pressing roller which is a pressing member brought into pressure contact with the fixing roller and rotated following the fixing roller, and is adapted to heat and press the sheet bearing the toner image thereon while passing the sheet between the fixing roller and the pressing roller to thereby effect a fixing process.

A fixing roller of the heater type is formed into a hollow cylindrical shape with a metallic core material as a base, and a heat generating member disposed along the central shaft of the fixing roller is held in the fixing roller by holding means. The heat generating member is, for example, a tubular heat generating heat such as a halogen lamp, and generates heat by a predetermined voltage being applied thereto. Since this halogen lamp is located along the central shaft of the fixing roller, the heat generated from the halogen lamp is uniformly radiated to the inner wall surface of the fixing roller, and the temperature distribution on the outer wall surface of the fixing roller becomes circumferentially uniform. The outer wall surface of the fixing roller is heated to a temperature (e.g. 150° C. to 200° C.) suited for the fixing process, and thereafter is maintained at that temperature. In this state, the fixing roller and the pressing roller are adapted to be rotated in opposite directions while being in pressure contact with each other, and nip therebetween the sheet bearing the toner image thereon. Consequently, in the pressure contact portion (hereinafter referred to also as the nip portion) between the fixing roller and the pressing roller, the toner on the sheet is melted by the heat of the fixing roller, and becomes fixed on the sheet by the pressure acting from the two rollers.

Also, as a heating apparatus, there has been proposed a fixing apparatus of the induction heating type utilizing high frequency induction as a heating source, as disclosed in Japanese Patent Application Laid-Open No. 59-33787. In this fixing apparatus of the induction heating type, coils which are magnetic flux producing means are concentrically disposed in a holloe cylindrical fixing roller formed of a metal conductor, and an induction eddy current may be created in the fixing roller by a high frequency magnetic field produced by a high frequency electric current being supplied to the coils, and the fixing roller itself may be caused to generate Joule heat by the skin resistance of the fixing roller itself. According to this fixing apparatus of the induction heating type, the fixing roller itself generates heat and therefore, electrothermal conversion efficiency is very much improved.

Now, to achieve the shortening of warm-up time in the fixing apparatus of the heater type and the fixing apparatus of the induction heating type, it is preferable that the thickness of the mandrel be small.

Particularly in the fixing apparatus of the induction heating type, it is so contrived that the fixing roller will be caused to generate heat by the skin resistance of the fixing roller itself, and even if the thickness of the fixing roller itself is great, the amount of generated heat will not be varied. Therefore, when the mandrel of the fixing roller is thick, even if the fixing apparatus is of the induction heating type, heat generating efficiency is rather reduced and it becomes difficult to obtain the effect of shortening the warm-up time. Therefore, when use is made of a mandrel formed of iron, nickel or the like which is a usually used ferromagnetic material, it is preferable that the thickness thereof be about 100 to 1000 $\mu$m.

However, when in the fixing apparatuses of the heater type and the induction heating type described above, a metal such as thin-walled iron or nickel is used as the mandrel of the fixing roller and in order to secure the fixing property, the high pressure force weighting by the pressing roller is effected on the fixing roller and the fixing apparatus is left as it is for a long period, there is the possibility that the thin-walled fixing roller will be plastically deformed and the flexure of the roller will occur.

Even if the fixing roller is not plastically deformed, when the pressure weighting by the pressing roller is effected on the fixing roller, there is the possibility that the fixing roller will be elastically deformed to thereby cause temporary flexure and therefore, the transferring material may be wrinkled during the conveyance thereof or a bad image may be caused by the warping of the trailing end of the transferring material, and the distance between the coil or core which is a heating source and the fixing roller may become unstable and the heat generation distribution may become uncontrollable.

Further, when sheets are repetitively passed and heated between the fixing roller and the pressing roller, there is the possibility that such a factor as the deterioration by the heat will be added and the destruction of the fixing roller will occur.

SUMMARY OF THE INVENTION

It is an object of the present invention to provide a fixing roller of which the shortening of the warm-up time is achieved and yet the deformation is prevented, and a fixing apparatus having the same.

It is another object of the present invention to provide a fixing roller having a metal layer of which the thickness is not less than 0.1 mm and not more than 2 mm, the tensile strength is 490 MPa or greater and the yield point is 294 MPa or greater.

It is still another object of the present invention to provide a fixing apparatus having a fixing roller having a metal layer, and a back-up member forming a nip with the fixing roller, wherein a recording material bearing an unfixed image thereon is nipped and conveyed by the nip, the unfixed image is fixed on the recording material, and the metal layer of the fixing roller has a thickness not less than 0.1 mm and not more than 2 mm, tensile strength of 490 MPa or greater, and a yield point of 294 MPa or greater.

Further objects of the present invention will become apparent from the following description.

DESCRIPTION OF THE PREFERRED EMBODIMENTS

Some embodiments of the present invention will hereinafter be described with reference to the drawings.

[First Embodiment]

A first embodiment of the present invention will first be described.

Figure 1:
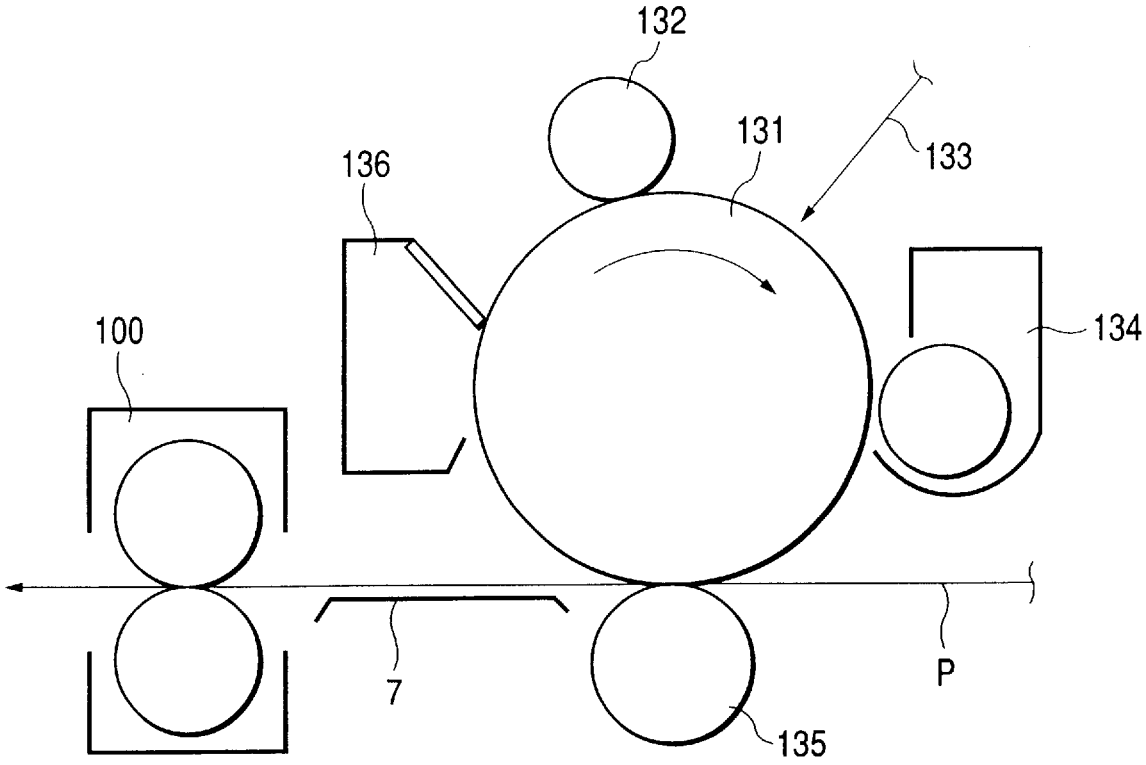
FIG. 1 shows an image forming apparatus to which a fixing apparatus carrying thereon a fixing roller which is an embodiment of the present invention is applicable.

FIG. 1 schematically shows the construction of an image forming apparatus according to the present embodiment. Such an image forming apparatus is a copier or a printer utilizing the transfer type electrophotographic process.

In such an image forming apparatus, an electrophotographic photosensitive body (hereinafter referred to as the rotary photosensitive body) 131 which is a latent image bearing body of a rotary drum type is first rotatively driven at a predetermined process speed (peripheral speed) in the clockwise direction of arrow.

The surface of the rotary photosensitive body 131 is then uniformly charged to a predetermined polarity and potential by a charging roller 132 which is a contact charging roller as photosensitive body charging means to which a predetermined charging bias is applied.

Thereafter, the exposure 133 of desired image information is done on the charged surface of this rotary photosensitive body 131 by image information exposing means portion (not shown) such as original image slit imaging exposure means or laser beam scanning exposure means, whereby an electrostatic latent image corresponding to the desired image information is formed on the surface of the rotary photosensitive body 131.

The latent image is developed as a toner image by a toner developing apparatus 134.

The toner image is transferred to a transferring material P which is a recording medium as a recording material conveyed at predetermined timing from a paper feeding portion (not shown) to a transferring portion which is a pressure contact nip portion between the rotary photosensitive body 131 and a transferring roller 135 brought into contact therewith and to which a predetermined transfer bias is applied.

The transferring material P which has passed through the transferring portion and has received the transfer of the toner image is separated from the surface of the rotary photosensitive body 131, and is conveyed and introduced, for example, into a heating apparatus 100 as a fixing apparatus and is subjected to the heating and fixing process for the unfixed toner image, and is outputted as a copy or a print.

On the other hand, the surface of the rotary photosensitive body 131 after the transfer of the toner image to the transferring material P is subjected to the removal of a residual adhering substance such as untransferred toner by a cleaning apparatus 136 and is cleaned, and is repetitively used for image formation.

Figure 2:
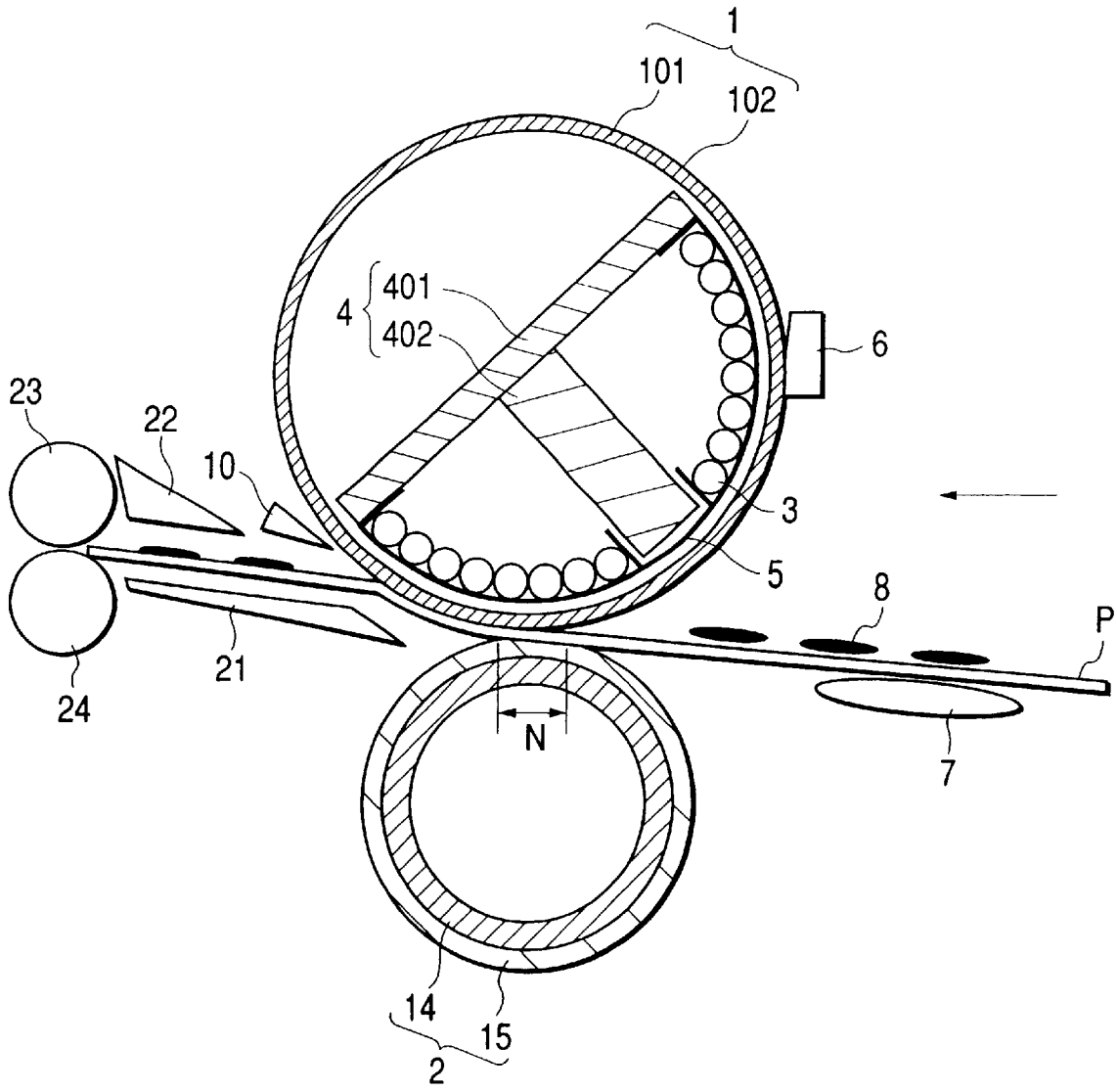
FIG. 2 shows the fixing apparatus.

FIG. 2 is a cross-sectional view schematically showing the heating apparatus 100 of the induction heating type according to the present embodiment.

The heating apparatus 100, as shown in FIG. 2, is provided with a fixing roller 1 which is a heating member, a pressing roller 2 which is a pressing member which is a back-up member, and an excitation coil 3 which is magnetic flux producing means.

The fixing roller 1 has a releasing layer 102 formed of fluorine resin such as PTFE or PFA having a thickness of e.g. 10 to 50 $\mu$m provided on an area of 320 mm in the axially central portion which is a paper passing area to enhance the releasing property of the surface of a mandrel 101 which is a metal layer which is a cylinder made of high tensile steel having an outer diameter of 40 mm, a thickness of 0.7 mm and a length of 340 mm.

The pressing roller 2 comprises a hollow mandrel 14 and an elastic layer 15 which is a surface releasable heat resisting rubber layer (a surface length of 325 mm) having a thickness of 5 mm formed on the outer peripheral surface thereof. This pressing roller 2 has bearing portions formed on the opposite ends thereof, and is rotatably mounted on a fixing unit frame (not shown).

The fixing roller 1 and the pressing roller 2 are rotatably supported and in the present embodiment, only the fixing roller 1 is designed to be driven.

The pressing roller 2 is in pressure contact with the surface of the fixing roller 1 and is so disposed as to be rotated by the frictional force in the pressure contact portion N (nip portion). Also, the pressing roller 2 is pressed toward the rotary shaft of the fixing roller 1 by a construction (not shown) using a spring or the like. In the present embodiment, the pressing roller 2 is loaded with weight of about 50 kgf (50×9.8=490 N), and in that case, the width (nip width) of the pressure contact portion is about 6 mm. Depending on the convenience, the load by the pressing roller 2 may be changed to thereby change the nip width.

Figure 3:
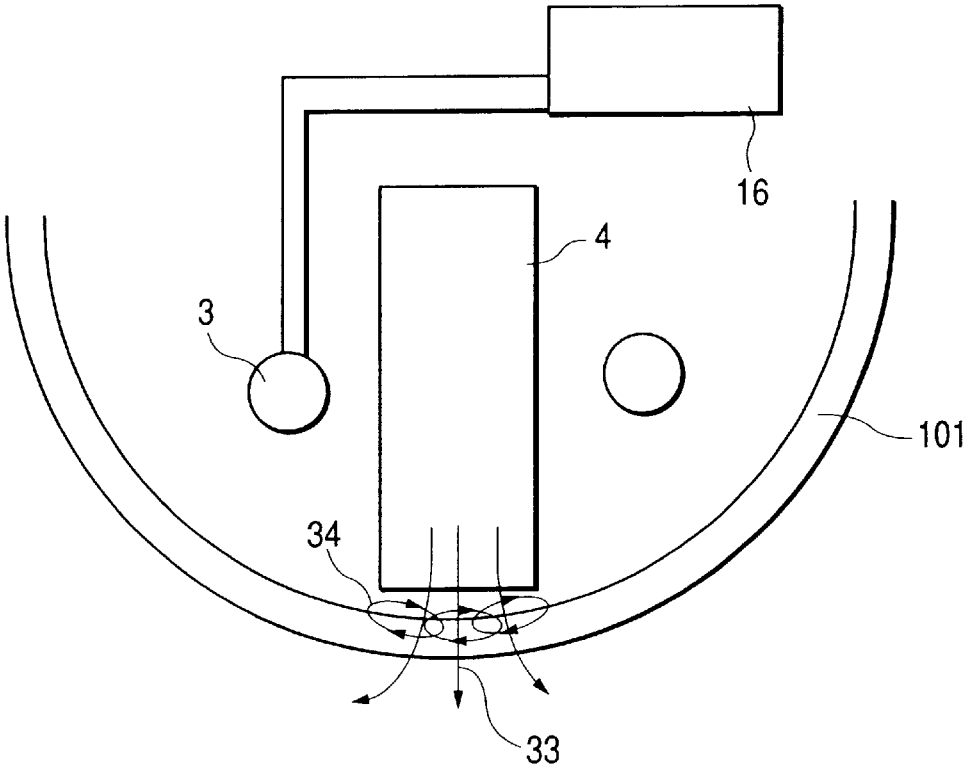
FIG. 3 illustrates the principle of heating of the induction heating type.

The principle of the heating in this fixing nip portion will now be described with reference to FIG. 3.

A magnetic flux produced by an electric current applied to the excitation coil 3 by an excitation circuit 16 is directed to a high permeability core 4 and causes the mandrel 101 of the fixing roller 1 to produce a magnetic flux 33 and an eddy current 34 in the fixing nip portion N. Heat is generated by this eddy current 34 and the specific resistance of the fixing roller.

The excitation coil 3 is disposed in a holder 5 formed of heat resisting resin such as PPS, PEEK or phenol resin so as to surround the core 4. An alternating current of 10 to 100 kHz is applied to this excitation coil 3. A magnetic flux induced by the alternating current lets an eddy current flow in the inner surface of the fixing roller 1 which is an electrically conductive layer, and generates Joule heat. To increase this generated heat, the number of turns of the excitation coil 3 may be increased, or a material high in permeability and low in residual magnetic flux density such as ferrite or Permalloy may be used for the core 4, or the frequency of the alternating current may be made high.

A thermistor 6 which is a temperature sensor is disposed so as to abut against the lengthwisely (axially) central portion of the surface of the fixing roller 1, and the supply of electric power to the excitation coil 3 is increased or decreased on the basis of the detection signal of the thermistor 6, whereby the surface temperature of the fixing roller 1 is automatically controlled so as to become a predetermined constant temperature.

A conveying guide 7 is disposed at a location for guiding the transferring material P conveyed while bearing the unfixed toner image 8 thereon to the pressure contact portion (nip portion) between the fixing roller 1 and the pressing roller 2.

A separating pawl 10 is disposed in contact with or in proximity to the surface of the fixing roller 1. The reference numeral 21 designates a lower guide for the transferring material P which has passed through the nip N, the reference numeral 22 denotes an upper guide, and the reference numerals 23 and 24 designate a pair of rollers for discharging the transferring material P.

The core 4 is comprised of a first core 401 and a second core 402 which are disposed in orthogonal relationship with each other.

The fixing, roller 1 will now be described in detail.

The mandrel 101 of the fixing roller 1 uses high tensile steel, and in the present embodiment, uses high tensile steel (HT50) having tensile strength of 498 MPa (51 kgf/mm$^2$ ($51\times9.8\times10^6=4.998\times10^8$ N/m$^2$)) and a yield point of 353 MPa (36 kgf/mm$^2$ ($36\times9.8\times10^6=3.528\times10^8$ N/m$^2$)) drawn into a cylinder having a thickness of 0.3 mm and a diameter of 40 mm. The opposite end portions of the mandrel 101 are 0.5 mm for the reinforcement of strength. The high tensile steel has a suitable amount of other alloy element than carbon, e.g. chromium, molybdenum, niobium, vanadium, tungsten or the like added to a conventional steel material, and is improved in strength without tenacity and rollability being spoiled.

Next, regarding the fixing roller using the present embodiment, on the basis of the comparison with the fixing rollers of Comparative Examples 1 to 3 by the materials shown below, an experiment for evaluating the performance regarding compressive deformation, durability destruction and frequency of paper wrinkling was carried out.

Comparative Example 1 a conventional iron roller (STKM11); tensile strength 343 MPa, yield point 245 MPa Comparative Example 2 nickel; tensile strength 250 MPa, yield point 170 MPa

Comparative Example 3

STKM13; tensile strength 441 MPa, yield point 304 MPa

<Present Embodiment> high tensile steel; tensile strength 490 MPa, yield point 314 MPa

In any of the rollers of the above-mentioned Comparative Examples 1 to 3 and the present embodiment, the shape is a straight shape without contraction of area, and the thickness is 0.3 mm and the outer diameter is 40 mm, and PTFE of 20 $\mu$m is applied as a releasing layer to the surface.

[Compressive Deformation]

In an environment of 32° C. and 80%, the fixing roller was subjected to the pressing of 60 kg by the pressing roller, and was left as it was for 1000 hours. In this experiment, the occurrence of compressive deformation was seen in the fixing rollers according to Comparative Examples 1 and 2, but no change was seen in the fixing rollers according to Comparative Example 3 and the present embodiment.

[Durability Destruction]

Under a condition of 50 kg press, paper was passed to the nip portion at a process speed of 300 mm/sec. The fixing rollers according to Comparative Examples 1, 2 and 3 caused a crack in the mandrels thereof for 50,000 sheets, 30,000 sheets and 500,000 sheets, respectively, but the fixing roller according to the present embodiment caused no crack even for 600,000 sheets.

[Frequency of Paper Wrinkling]

The flexure of the fixing roller and the frequency of paper wrinkling were examined.

The amount of flexure was evaluated with respect to the time of repose and the time of driving by the use of a three-dimensional measuring machine, and paper wrinkling was evaluated with respect to the frequency of occurrence when 30,000 sheets were passed.

Common conditions: mandrel of fixing roller having diameter of 40 mm (ϕ40), thickness 0.3 mm, deflection 0.01, weighting 490 N (50 kgf).

The result of the evaluation of the frequency of paper wrinkling is shown in Table 1 below.

TABLE 1

| Material | Tensile strength [MPa] | Modulus of longitudinal elastisity [Pa] | Amount of flexure (during repose) [$\mu$m] | Amount of flexure (during driving) [$\mu$m] | frequency of paper wrinkling [%] |
|---|---|---|---|---|---|
| Comparative Ex. 1 | 343 | 21 | 80 | 325 | 1.1 |
| Comparative Ex. 2 | 250 | 21.5 | 75 | 380 | 3.2 |
| Comparative Ex. 3 | 441 | 21 | 81 | 211 | 0.1 |
| First embodiment | 490 | 21 | 80 | 98 | 0 |

Generally the amount of flexure of the fixing roller during the repose thereof depends on modulus of longitudinal elasticity, and in the present experiment, all the examples exhibited almost the same values. However, it has been found from over experiment that the amount of flexure during driving depends on tensile strength and the frequency of paper wrinkling also depends on this amount.

The yield point of the high tensile steel of the present embodiment is 314 MPa, but if tensile strength was 490 MPa or greater, a result similar to that of the present embodiment was exhibited even if the yield point was of the order of 294 MPa.

From the above-noted result, the condition for making the mandrel thin and yet preventing the deformation of the mandrel is that tensile strength is 490 MPa or greater and yield point is 294 MPa or greater.

Under this condition, it was possible to make the thickness of the mandrel small up to 0.1 mm. From the viewpoint of strength, it is preferable that the thickness of the mandrel be great, but if the mandrel becomes too thick, a warm-up time will become long and therefore, the upper limit of the thickness of the mandrel is the order of 2 mm. Accordingly, the thickness of the mandrel is not less than 0.1 mm and not more than 2 mm.

The high tensile steel used in the present embodiment is composed of iron and carbon, silicon, manganese or the like added thereto, but may be composed of iron and chromium, molybdenum or the like added thereto. It is also possible to use a chromium alloy having chromium as a main material or a molybdenum alloy having molybdenum as a main material, and if such an alloy has volume resistivity of 10 Ω·cm or greater, heat generating efficiency will be good and such alloy is more desirable.

Also, to restrain the temperature rise of a non-paper passing portion during the passage of small-sized paper by the use of a thin-walled roller, it is preferable that the heat conductivity of the roller be 10 W/m·k or greater.

As described above, in the present embodiment, the mandrel of the roller is formed of high tensile steel or an alloy having a thickness not less than 0.1 mm and not more than 2 mm, tensile strength of 490 MPa or greater and a yield point of 294 MPa or greater and therefore, it is possible to achieve the shortening of the warm-up time of the fixing roller and yet restrain the deformation of the roller, and it is possible to prevent the occurrence of the temperature unevenness of the roller, paper wrinkling, bad images, etc.

[Second Embodiment]

A second embodiment of the present invention will now be described with reference to FIG. 4. In the second embodiment, members similar to those in the first embodiment are given the same reference numerals and need not be described.

Figure 4:
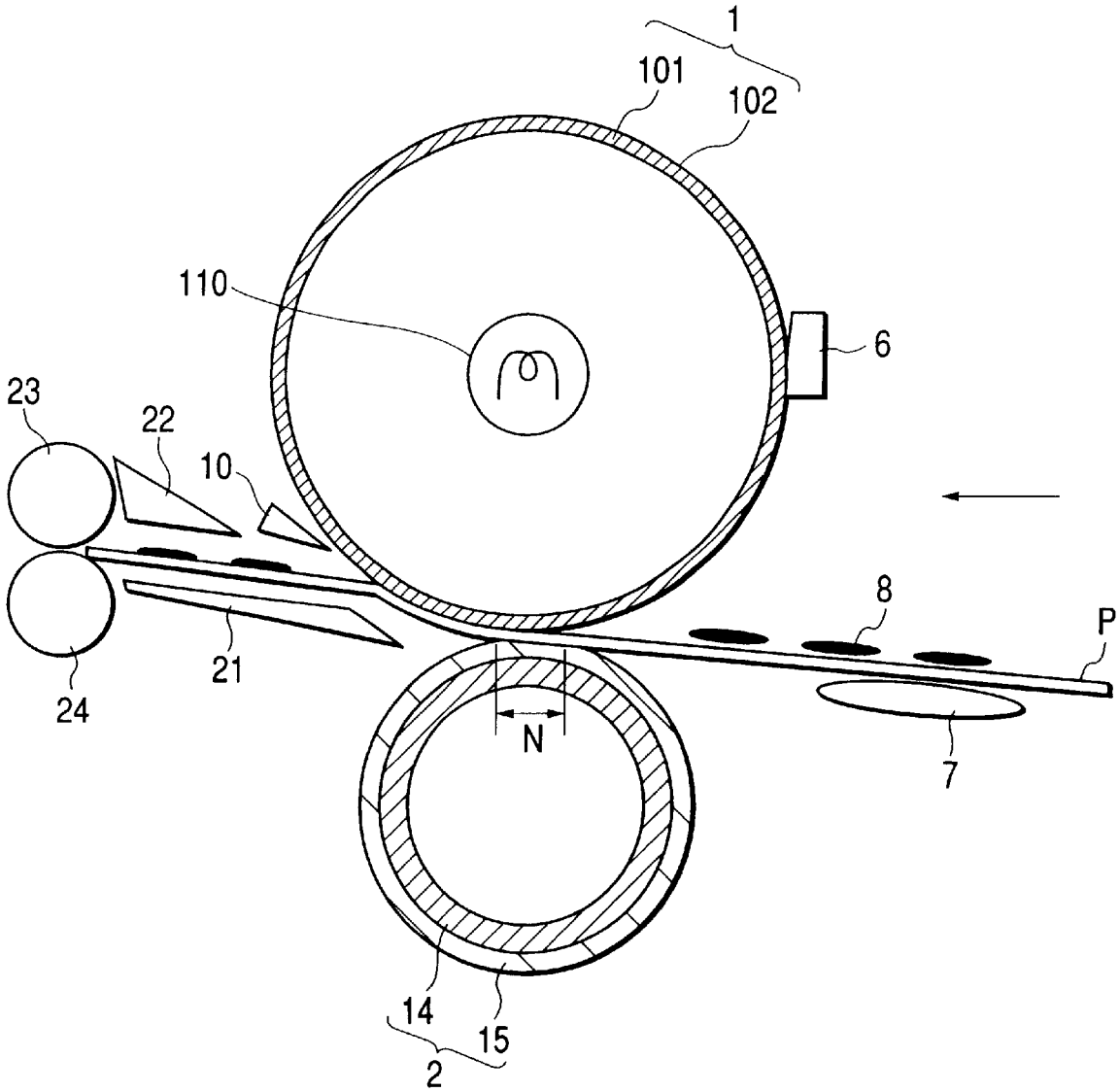
FIG. 4 shows another fixing apparatus.

FIG. 4 is an enlarged transverse cross-sectional view schematically showing the construction of a heating apparatus according to the second embodiment of the present invention.

In the present embodiment, the heating apparatus has as a heat source a halogen heater 110 which is a heat generating member disposed along the axis of the fixing roller 1, in lieu of the excitation coil 3, the core 4 and the holder 5 in the first embodiment.

The construction of the fixing roller is the same as that in the first embodiment.

Thus, again in the present embodiment, the heating apparatus is short in rising time and can weight a high pressing force and therefore can obtain good fixing performance.

[Third Embodiment]

A third embodiment of the present invention will now be described with reference to FIG. 5. In the third embodiment, members similar to those in the first embodiment are given the same reference numerals and need not be described.

Figure 5:
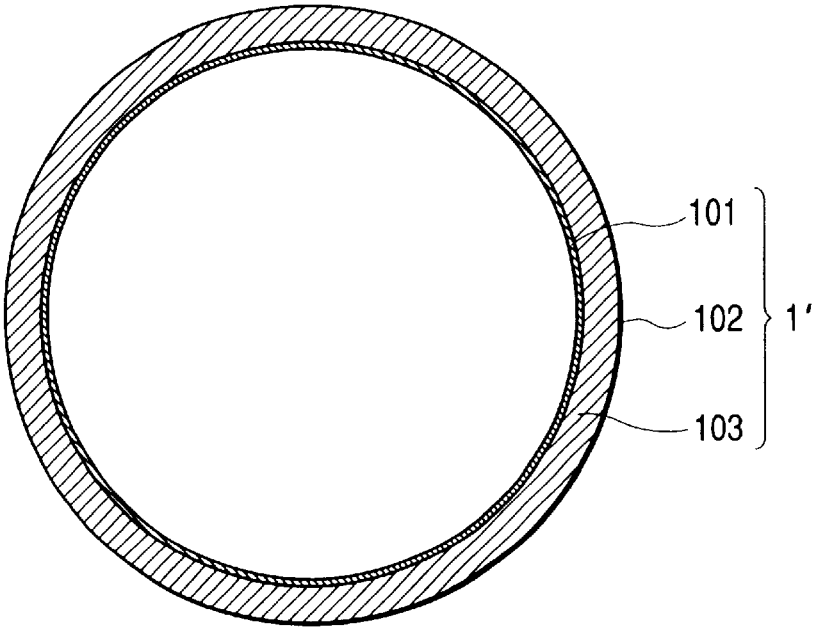
FIG. 5 shows another fixing roller.

FIG. 5 is a schematic cross-sectional view of a fixing roller which is a heating member according to the third embodiment of the present invention.

In the present embodiment, the fixing roller 1' has an elastic layer 103 disposed between a mandrel 101 and a releasing layer 102. Thereby, an improvement in the fixing property and the coping with a color toner can be achieved.

The mandrel in the present embodiment is the same as the mandrel in the first embodiment, and the present embodiment can also achieve an effect similar to that of the first embodiment.

The heating apparatus of the present invention can of course be used not only as the fixing apparatus as described in the first to third embodiments, but also as a heating apparatus such as an apparatus for heating a transferring material bearing an image thereon and improving the surface property (luster or the like) thereof, an apparatus for preliminarily fixing, or an apparatus for feeding sheet-like articles and drying or laminating them.

While the embodiments of the present invention have been described above, the present invention is in no way restricted to the above-described embodiments, but all modifications are possible within the technical idea of the present invention.

What is claimed is:

1. A fixing roller comprising:

a metal layer;

said metal layer having a thickness not less than 0.1 mm and not more than 2 mm, a tensile strength of 490 MPa or greater, and a yield point of 294 MPa or greater.

2. A fixing roller according to claim 1, wherein a heat conductivity of said metal layer is 10 W/m·k or greater.

3. A fixing roller according to claim 1, wherein a volume resistance value of said metal layer is 10 Ω·cm or greater.

4. A fixing roller according to claim 1, wherein said metal layer is formed of a high tensile steel.

5. A fixing roller according to claim 1, wherein said metal layer is formed of an alloy.

6. A fixing roller according to claim 1, having a releasing layer outside said metal layer.

7. A fixing roller according to claim 6, having an elastic layer between said metal layer and said releasing layer.

8. A fixing apparatus comprising:

a fixing roller having a metal layer; and a back-up member forming a nip with said fixing roller;

wherein a recording material bearing an unfixed image is nipped and conveyed by said nip, and the unfixed image is fixed on the recording material; and wherein the metal layer of said fixing roller has a thickness not less than 0.1 mm and not more than 2 mm, a tensile strength of 490 MPa or greater, and a yield point of 294 MPa or greater.

9. A fixing apparatus according to claim 8, wherein a heat conductivity of said metal layer is 10 W/m·k or greater.

10. A fixing apparatus according to claim 8, wherein a volume resistance value of said metal layer is 10 Ω·cm or greater.

11. A fixing apparatus according to claim 8, wherein said metal layer is formed of a high tensile steel.

12. A fixing apparatus according to claim 8, wherein said metal layer is formed of an alloy.

13. A fixing apparatus according to claim 8, having a releasing layer outside said metal layer.

14. A fixing apparatus according to claim 13, having an elastic layer between said metal layer and said releasing layer.

15. A fixing apparatus according to claim 8, wherein a pressure per unit length in said nip is 632 N/m or greater.

16. A fixing apparatus according to claim 8, wherein said fixing roller has a heat generating source therein.

17. A fixing apparatus according to claim 8, further comprising magnetic flux producing means for producing a magnetic flux, wherein an eddy current is produced in said fixing roller by said magnetic flux producing means, and said fixing roller generates heat by the eddy current.

18. A fixing apparatus according to claim 8, wherein said back-up member is a roller.

* * * * *

UNITED STATES PATENT AND TRADEMARK OFFICE

CERTIFICATE OF CORRECTION

PATENT NO. : 6,400,924 B1
DATED : June 4, 2002
INVENTOR(S) : Osamu Watanabe

It is certified that error appears in the above-identified patent and that said Letters Patent is hereby corrected as shown below:

Column 1,
Line 52, “holloe” should read -- hollow --.

Column 4,
Line 60, “fixing,” should read -- fixing --.

Column 6,
Line 20, “over experiment” should read -- other experiments --.

Column 7,
Line 8, “is short in rising time and can weight” should read -- has a short warm-up time and can exert --.

Signed and Sealed this

Fifth Day of November, 2002

*Attest:*

*Attesting Officer*

JAMES E. ROGAN
*Director of the United States Patent and Trademark Office*